United States Patent [19]

Skach, Jr. et al.

[11] Patent Number: 4,559,084

[45] **Date of Patent: * Dec. 17, 1985**

[54] SALT-COATED MAGNESIUM GRANULES

[75] Inventors: Edward J. Skach, Jr., Freeport; George B. Cobel, Lake Jackson, both of Tex.

[73] Assignee: The Dow Chemical Company, Midland, Mich.

[ * ] Notice: The portion of the term of this patent subsequent to Jan. 29, 1997 has been disclaimed.

[21] Appl. No.: 471,581

[22] Filed: Mar. 3, 1983

Related U.S. Application Data

[63] Continuation-in-part of Ser. No. 267,124, May 26, 1981, Pat. No. 4,384,887, which is a continuation of Ser. No. 94,131, Nov. 14, 1979, Pat. No. 4,279,641, which is a continuation-in-part of Ser. No. 936,977, Aug. 25, 1978, Pat. No. 4,186,000.

[51] Int. Cl.[4] ..... C22C 1/04

[52] U.S. Cl. ..... 75/0.5 B; 75/67 R; 264/7

[58] Field of Search ..... 75/24, 67 R, 0.5 B, 75/254; 204/70; 264/6

[56] References Cited

U.S. PATENT DOCUMENTS

| | | | |
|---|---|---|---|
| 4,186,000 | 1/1980 | Skach, Jr. et al. | 75/0.5 B |
| 4,279,641 | 7/1981 | Skach, Jr. et al. | 75/0.5 B |
| 4,384,887 | 5/1983 | Skach, Jr. et al. | 75/0.5 B |
| 4,410,356 | 10/1983 | Skach, Jr. | 75/0.5 B |
| 4,421,551 | 12/1983 | Mueller | 75/0.5 B |

FOREIGN PATENT DOCUMENTS 58322 8/1982 European Pat. Off. .

*Primary Examiner*—Christopher W. Brody
*Attorney, Agent, or Firm*—W. J. Lee

[57] ABSTRACT

Small rotund magnesium (or Mg alloy) granules dispersed in a friable salt matrix are obtained by preparing a molten salt mixture containing molten magnesium (or Mg alloy) stirring to effect good dispersion, and cooling the molten mixture to effect freezing of the magnesium (or Mg alloy) as small rotund globules dispersed in a solid friable matrix.

20 Claims, 8 Drawing Figures

SALT-COATED MAGNESIUM GRANULES

CROSS-REFERENCE TO RELATED APPLICATIONS

Figure 1:
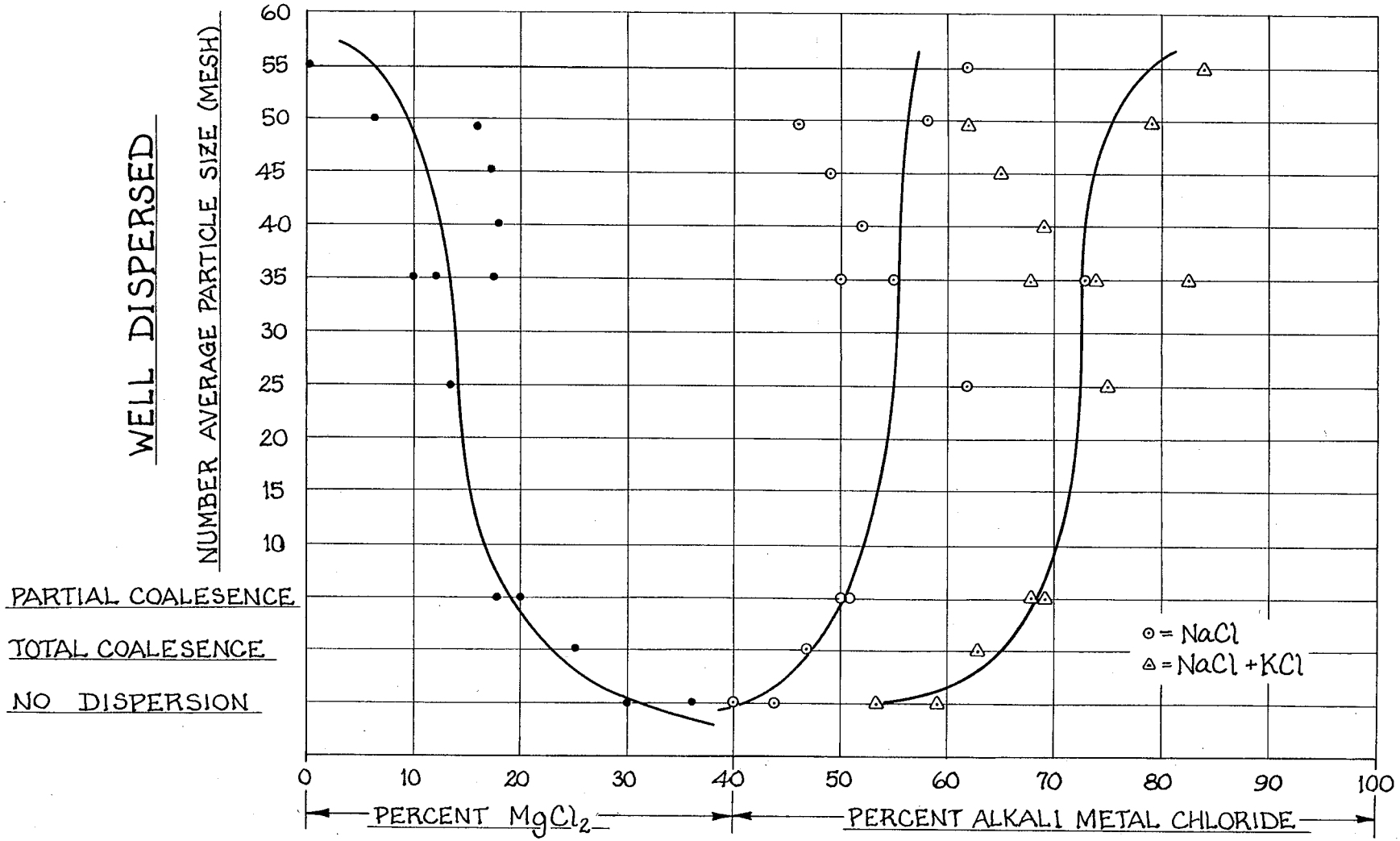

This application is a continuation-in-part of application Ser. No. 267,124, filed May 26, 1981, now U.S. Pat. No. 4,384,887, which, itself, is a continuation of Ser. No. 094,131 filed Nov. 14, 1979, now U.S. Pat. No. 4,279,641, which is, itself, a continuation-in-part of Ser. No. 936,977, filed Aug. 25, 1978, now U.S. Pat. No. 4,186,000.

BACKGROUND AND PRIOR ART OF THE INVENTION

It is well known in the iron and steel industry that Mg metal is a useful inoculant for addition to molten ferrous metals; the Mg is known to be an effective desulfurizing agent for steel and is an effective nodularizing agent for preparing ductile iron.

It is also well known that Mg, as small particles, may be added to the molten ferrous metal by being carried through a lance by a stream of gas or in a carrier.

Mg metal, especially when in finely-divided form, is easily oxidized and is sometimes pyrophoric. In contact with water, it gives off $H_2$ which, in ample quantities, presents an explosion or fire hazard. Various methods for reducing the pyrophoric and explosive hazards have been developed over the years and these developments have met with sufficient success to cause the iron and steel industry to remain interested in obtaining an economical, small particle Mg inoculant material which is relatively safe to store and use and which performs in a consistent, effective manner.

In the electrolytic production of magnesium by the electrolysis of molten $MgCl_2$, it has been known for many years that the presence of boron values in the $MgCl_2$ is detrimental to the complete coalescence of molten Mg formed during the electrolysis. It is known that seawater contains small amounts of boron and when seawater is treated with an alkaline material to precipitate $Mg(OH)_2$, a small amount of boron values may be also precipitated. Then when the $Mg(OH)_2$ is chlorinated to obtain $MgCl_2$ for use as a feed material (also called "cell bath") to an electrolytic Mg cell, a detrimental amount of the boron values may accompany the $MgCl_2$ unless steps are taken to remove, or at least substantially reduce, the amount of boron values. Thus, in the field of magnesium production, the attention given to boron values has been toward removing the boron values from the system. Even with such attempts made over the years to obtain substantially complete coalescence of molten Mg, formed in the fused salt electrolysis of $MgCl_2$, so as to obtain a separable molten Mg phase, there is always some Mg which remains dispersed as droplets in the molten salt and in the cell sludge which is removed from the cell. When the cell sludge or the cell bath material is removed from the cell and freezes to a relatively hard (though friable) mass the small beads of Mg trapped therein in small quantities may be wasted unless there is provided an economical means for salvaging or utilizing the materials. Ordinarily the amount of Mg trapped in these frozen salt mixtures is only a small percentage of, say, less than 20%, usually less than about 15% by weight.

It is also known that in Mg alloying processes, e.g., the alloying of Mg and Al, the alloying is usually performed under a protective blanket of a molten salt flux.

Some of the Mg alloy is retained in the flux material removed from the alloying process as a "slag". These alloying-process slags, somewhat similar to the frozen cell baths or cell sludges, contain small percentages of Mg alloy as discrete particles trapped therein.

In the past, efforts have been made to pulverize these matrices of sludges and slags into particle sizes suitable for commercial use as inoculants for molten ferrous melts, but because of batch-to-batch variations and the high salt content, the efforts had only limited success.

Also, there have been commercial efforts over the years to pulverize these sludges and slags to free the Mg particles from entrapment in the friable salt matrix and screen the particles from the salt or wash the water soluble salts from the Mg particles. The Mg particles thus freed have been remelted for recovery and cast into ingots. The cost of obtaining such secondary Mg or Mg alloy in ingot form from sludges and slags requires comparison with the cost of primary Mg or Mg alloy ingots obtained from the principal sources, i.e., the electrolytic cell output and the alloying process output. Usually, if the market price of primary Mg or Mg alloy ingot is down because of decreased market demand, the recovery of secondary Mg or Mg alloy ingot from sludges or slags is not economical, so there is little or no incentive to perform the recovery.

However, we have found there are economical incentives for developing processes which will recover Mg or Mg alloy pellets from entrapment in sludges and slags (even though the pellets still contain a surface coating thereon of the sludge or slag material) for use other than as casting into ingots. In fact, such pellets are useful as an inoculant material for molten ferrous melts and the protective salt coating is found to be beneficial, rather than detrimental.

The separation of solid Mg metal spheroids from entrapment in a solid contiguous matrix of a friable salt or mixture of salts presents particular problems to an investigator who may desire to recover the Mg in its spheroidal form and also retain on each spheroid a thin protective coating of the matrix material. Whereas it has been known for many years that such a Mg-containing matrix is removed as cell sludge from the electrolysis of molten $MgCl_2$ and as a slag material from Mg or Mg-alloy casting operations, attempts to recover the Mg or Mg alloy particles by grinding or intensive ball-milling have generally resulted in smashing, breaking, or flattening a large portion of the Mg particles. Such deformed particles may be acceptable if the principal purpose of recovering the metal is that of re-melting it for coalescence or for re-casting as ingots.

In certain embodiments of the present invention, however, what is of special interest is the recovery, from the solid matrix, of Mg spheroids which each have a thin protective coating of the matrix remaining. Such spheroidal Mg particles are of particular interest for use in inoculating molten ferrous metals, e.g., the desulfurization of steel. The thin protective coating of matrix helps avoid the hydrolysis of Mg by moisture or the oxidation of Mg by air. Mg particles which are substantially flattened or elongated or which do not have a high degree of rotundity are not as readily useful in operations where the particles are injected through a lance beneath the surface of molten iron or steel. Ideally, the operators of such lances would prefer that the Mg particles be of consistent size, consistent Mg content, and consistent rotundity in order to avoid unwelcome variances during the inoculation process.

The use of various grinding or pulverizing machines for reducing the particle size of various solid materials, such as rocks, ores and minerals, is well known. The use of screens or nests of screens to separate particles into various ranges of sizes is also well known. Very often the screens are vibrated to effect better, faster separations.

The separation of rotund beads from irregular shaped particles on a slanted surface is taught, e.g., in French Pat. No. 730,215; U.S. Pat. No. 1,976,974; U.S. Pat. No. 2,778,498; U.S. Pat. No. 2,658,616; and U.S. Pat. No. 3,464,550. A U.S. Department of Interior, Bureau of Mines publication R.I. 4286, dated May, 1948 on "New Dry Concentrating Equipment" contains information on a vibrating-deck mineral shape separator; the separator disclosed is a vibrated tilted table where the trajectory of particles across the surface is dependent on the shape of the particles. There are various sludges and slags from mining and metallurgical operations which are known to contain inclusions of metal droplets, such as copper, nickel, tin, and others.

U.S. Pat. No. 3,037,711 teaches the use of beater mills or hammer mills for pulverizing dross from metal particles, then separating the fines from the particles by suction.

General information about pulverizers, screens, and tabling may be found in, e.g., "Chemical Engineers Handbook" by Robt. H. Perry, Editor, published by McGraw-Hill.

U.S. Pat. No. 3,881,913 and U.S. Pat. No. 3,969,104 disclose the preparation of salt-coated Mg granules by an atomization technique and also disclose that such granules are useful for injection into molten iron through a lance.

Patents which teach the formation of small particles of Mg or Mg alloy on a spinning disc are, e.g., U.S. Pat. No. 2,699,576; U.S. Pat. No. 3,520,718; and U.S. Pat. No. 3,881,913.

The salt which may be employed herein as the "matrix" material may be a single compound, such as a halide of Na, K, Li, Mg, Ca, Ba, Mn, or Sr or may be a mixture of two or more of these salts. It is possible, and in some cases desirable, to employ mixtures of salts wherein the halide of one or more of the salts is a different halide than of the other salts. For instance, mixtures of $MgCl_2$, NaCl, LiCl (or KCl), and $CaF_2$ may be employed in various proportions. As used herein, the term "salt" comprises ingredients which are predominantly halide salts, but may also contain up to about 25% of substantially inert oxides, additives, or other salts. In those embodiments wherein no boron, carbon, or other dispersing aids are employed, it is necessary to limit the amount of fluoride salts to less thant about 2%, and the amount of $MgCl_2$ to less than about 22%.

Various patents have described the molten salt mixtures, containing $MgCl_2$, which may be employed in electrolytic cells for the electrolytic production of Mg metal, e.g., U.S. Pat. No. 2,888,389; U.S. Pat. No. 2,950,236; and U.S. Pat. No. 3,565,917. It is disclosed that the composition of the salt mixture may be varied in order to adjust the density to be greater than, or less than, molten Mg metal. Sludges formed in such electrolytic Mg processes are known to contain Mg metal particles entrapped in a matrix of salt, and, usually there are some Mg oxide values also present, due to contact with air or moisture. The use of fluorides in the salt mixtures as coalescing agents for the Mg metal is disclosed. Mixtures of salts are taught in U.S. Pat. No. 3,881,913 which are recognizable as mixtures such as are known to be employed in electrolytic Mg production as "cell bath" electrolyte compositions. Such cell bath compositions are also known to be present in Mg cell sludge and when the cell sludge is ground up to free the small beads of Mg metal trapped therein, some of the salt mixture is found to be present on the Mg beads as a thin coating. De-watered carnallite is used in some electroytic Mg processes as the source of $MgCl_2$ which is reduced to Mg metal.

At the 6th SDCE International die casting congress, organized by The Society of Die Casting Engineers, Inc., at Cleveland, Ohio on Nov. 16–19, 1970, there was a paper (Paper No. 101) on "Factors Controlling Melt Loss in Magnesium Die Casting", authored by J. N. Reding and S. C. Erickson. The paper discloses the entrapment of Mg particles and Mg alloy particles in sludges and slags, and discloses studies about coalescing agents and dispersion agents (emulsifiers) for the Mg particles. It also discloses the grinding, in a ball mill, of a Mg-containing sludge to recover the Mg particles from entrapment therein.

Therefore, sludge material from Mg-producing processes, or from Mg-casting operations are known to contain Mg metal entrapped therein. In the Mg-producing processes, e.g., the electrolyzing of molten $MgCl_2$ in the presence of other molten salts to produce $Cl_2$ and molten Mg, the sludge material is composed of metal salts, oxides, impurities, and contaminants and contains a relatively small amount of Mg particles of various sizes dispersed therein.

During Mg casting, or Mg-alloy casting, the melt flux is usually provided on the surface of the molten metal in the melting vessel to prevent or retard contact of the metal with air or moisture and to prevent Mg fires. Such fluxes are usually mixtures of molten salts such as disclosed in U.S. Pat. No. 2,327,153 which also discloses that small Mg beads become trapped in the frozen sludge or slag as discrete fine globules having a diameter as small as 0.01 inch. The patent also discloses remelting and stirring the sludge or slag in order to get the small Mg beads to coalesce into large beads of about 0.5 inch or larger diameter, then partly cooling and separating the frozen beads from the still-molten salts by filtration.

Thus, the metal salt compositions of Mg cell sludges, Mg-casting slags, and Mg alloy-casting slags are a matter of record and are known to comprise various mixtures and ratios of alkaline metal salts, alkaline earth metal salts, some oxides and, generally, some impurities and contaminants.

An object of the present invention is to recover rotund, salt-coated Mg particles, or Mg alloy particles, from entrapment in a contiguous, friable matrix of salt, sludge or slag material.

Another object of the present invention is the preparation of a contiguous, friable, matrix of salt material containing dispersed therein discrete, rotund particles of Mg or Mg alloy.

A further object is to recover such rotund, salt-coated particles by a process which substantially avoids flattening, rupturing, or pulverizing said particles.

Another object is to recover such rotund Mg particles in a manner that the Mg particles retain only a thin protective coating of the sludge material in which they were entrapped.

Yet another object is to recover such coated Mg particles with a relatively consistent Mg content and relatively consistent particle size range and rotundity for use as an inoculant through a lance into a molten ferrous metal.

These, and other beneficial objects, believed to be apparent to practitioners of the relevant arts, are substantially attained by the presently disclosed invention.

SUMMARY OF THE INVENTION

A molten mixture comprising alkali metal salts and Mg or Mg alloy is stirred to effect good dispersion of the molten metal as small globules, then cooled to form small frozen beads of metal entrapped in a solid salt matrix.

DETAILED DESCRIPTIONS

FIGS. 1–4 and FIG. 8 are graphs provided as visual aids in demonstrating the effect of varying salt ingredients when no boron or other dispersing aid is added. The graphed points are from the tables of data hereinafter. The graphs are discussed more fully hereinafter.

Figure 5:
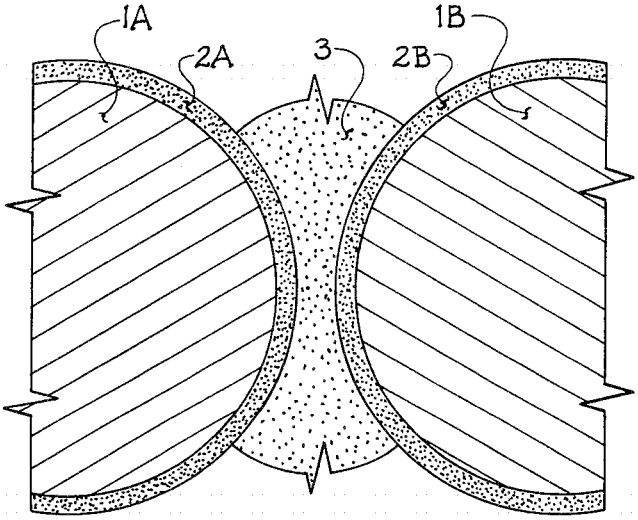
Figure 6:
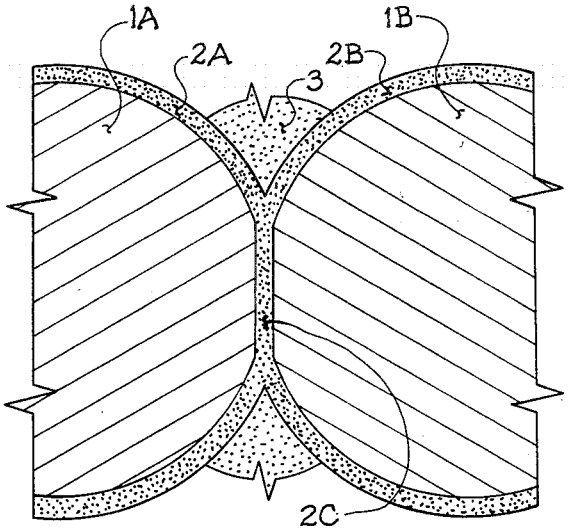
Figure 7:
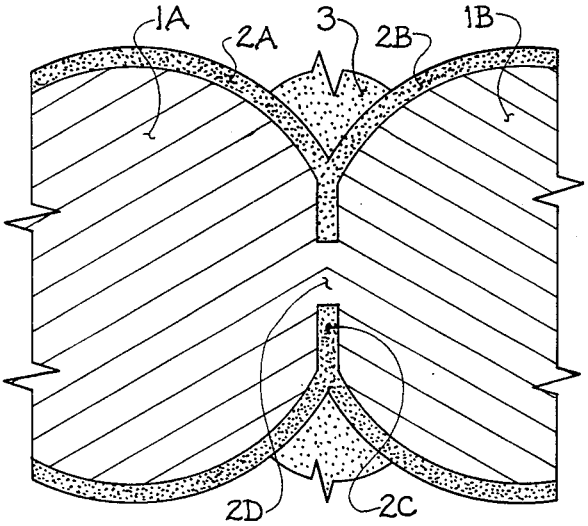

FIGS. 5–7 are presented as visual aids for describing distinctions between "well-dispersed" beads and "clustered" beads. The drawings are more fully described hereinafter.

The salt-coated Mg particles of interest in the present invention may be called "powders", "beads", "pellets", "granules", or other such term. The particles of greatest interest have a high degree of rotundity, being of a spherical and/or oval shape, and have a particle size in the range of about 8 mesh to about 100 mesh (U.S. Standard Sieve size). If the metal particles are to be used for the common practice of inoculating ferrous melts through a lance, the preferred particle size is generally within the range of about 10 mesh to about 65 mesh, though any particle size which will pass through an 8 mesh screen is operable and is readily adaptable for such use.

As used herein, the expression "high degree of rotundity" is applied to particles, beads, pellets, or granules which are spherical, or at least nearly spherical, but also includes oval shapes which roll easily on a slightly inclined surface. In contradistinction, particles which are substantially broken, smashed, flattened or irregular and which do not roll easily on a slightly inclined surface are not considered as having a high degree of rotundity. As used herein, "rotund" particles refer to metal particles having a "high degree of rotundity".

A "hammer mill", as used herein, implies an apparatus which employs a plurality of swinging or revolving hammer blades or projections which strike the material fed in, thereby pulverizing the friable material. For purposes of conciseness, the term "hammer mill" is used herein to include all mills which employ the same general type of impact on the particles as does the hammer mill.

"Mg-containing sludges or slags", sometimes referred to herein as "sludge", includes sludge or slag material from a Mg-producing process, or from a Mg-casting or Mg alloy casting operation, which contains particles of Mg (or Mg alloy) entrapped therein. The material which entraps the Mg particles is a friable, contiguous matrix of a frozen salt mixture which may also, and often does, contain some oxides, contaminants, and impurities. As used herein the expression "Mg" or "magnesium" is meant to include Mg alloys where Mg comprises the majority portion of the alloy. The most commonly known alloys are believed to be those of magnesium alloyed with aluminum or zinc.

In the practice of certain embodiments of the present invention it is essential that the Mg particles, which are recovered as the final product and which are intended for use as an inoculant for ferrous melts, have a high degree of rotundity and retain a thin protective coating of the sludge materials. The protective coating helps avoid the problems and dangers of handling, shipping, and storing the finely-divided Mg particles; without a protective coating the Mg particles are subject to rapid oxidation and, in some cases, may cause an explosion. The Mg particles recovered by the present invention are generally required to be substantially within the range of about 8 to about 100 mesh, preferably about 10 to about 65 mesh, in order to be readily acceptable to industries which inject them into molten ferrous metals through a lance.

Quite often sludge material is taken in molten or semi-molten form from the Mg-producing or Mg-casting operations and allowed to cool (freeze) into relatively large pieces or flakes. It is usually necessary to break up such large pieces into sizes which are acceptable in the hammer mill; this may be done by the use of jaw crushers or other convenient means.

It has been found that the pieces of Mg-containing matrix may be passed through a hammer mill to break up the friable matrix without causing an appreciable amount of flattening or breaking of the rotund Mg particles, yet the hammer mill leaves a coating of the matrix material on the Mg particles. The material may be passed through the hammer mill a plurality of times, or through a series of two or more hammer mills to assure substantially complete pulverization of matrix agglomerates without completely removing the protective coating on the Mg beads. In contradistinction, attempts to free the Mg particles from the matrix material by passing the material through roll-mills, crusher mills, or ball-mills containing large heavy rolls or bars generally results in smashing or flattening a sizeable portion of the rotund Mg particles. If the first pass through the impact mill is found to have been insufficient to have pulverized the friable matrix to the desired extent, it may be run through the mill again using smaller grate openings through which the particles fall.

After treatment in the hammer mill, the material may be screened to remove particles greater than 8 mesh and, if desired, remove any particles of less than 100 mesh. In the present process, however, there usually are no particles greater than 8 mesh in size. It is generally desirable to shake the screens to get rid of excess powdery matrix material which may still be clinging to the coated Mg-particles without actually being a part of the contiguous coating. There are a number of commercially available screens, including vibrated screens, which are suitable for use in this invention. Gentle grinding can be achieved by the use of vibrated screens which causes the particles to collide.

In those instances where the salt-mixture comprising the matrix material is hygroscopic, it is preferred that a relatively dry (less than about 35% relative humidity, preferably less than 20%) atmosphere be provided during the process. This is especially important in the screening and grinding steps because moisture-dampened particles tend to cling to surfaces which they contact and interfere with classification of the particles. Also, if the product is to be used for molten ferrous metal inoculations it is important that the particles be substantially dry and free-flowing.

The mixture of molten salt/molten Mg (or Mg alloy) to which the boron-containing dispersant is added may be, e.g., a Mg cell bath composition, a Mg cell sludge composition, a Mg (or Mg alloy) casting slag, or a Mg-alloying slag. Also, the molten mixture may be prepared by adding Mg (or Mg alloy) to the desired salt (or mixture of salts) or by adding additional Mg (or Mg alloy) to an existing Mg cell bath composition, Mg cell sludge composition, Mg (or Mg alloy) casting slag, or Mg-alloying slag. Adding additional Mg (or Mg alloy) to such already existing mixtures is very beneficial in that it improves the economics of recovering salt-coated metal beads from said existing mixtures. It is also within the purview of the present invention to add Mg metal to a salt (or salt mixture) which initially contains little or no Mg metal. Furthermore, the Mg metal which may be added to any of the above described salts may contain various ingredients or impurities, such as salt, dirt, oxides, other metals, mill scale, machining chemicals, and the like. Thus, "waste" pieces of Mg or scrap Mg may be incorporated into a useful product. Sometimes the sludges or slags from a Mg-production process or from a Mg-casting or Mg alloy-casting process will already contain very small amounts of boron, generally less than about 25 ppm (as boron based on Mg content); it would be unusual for such mixtures to contain as much as 50 ppm or more.

In those embodiments of the present invention wherein no dispersing aids (boron, carbon, etc.) are added to the salt mixture, it is necessary to keep the metal fluoride content to less than about 2% (preferably 0 to about 1.5%), the $MgCl_2$ content to less than about 22% (preferably 0 to about 20%), the alkali metal chloride (NaCl, KCl, and/or LiCl) to at least about 46% (preferably at least about 50%), and to employ salt mixtures which have a eutectic melting point at or below the melting point of Mg (or Mg alloy) in order that the Mg granules freeze first when the mixture is cooled; Mg metal melts at about 650° C. If a salt material being employed is one which contains too much $MgCl_2$, too much metal fluoride, and/or too little alkali metal chloride, then adjustments are conveniently made by adding more alkali metal chloride to the mixture so as to bring the salt components into the operable range.

A substantially pure eutectic mixture of NaCl and KCl which is substantially devoid of fluorides and/or $MgCl_2$ or other coalescence agents, and which has a freezing point below that of the Mg or Mg alloy being used therewith, is a suitable molten salt material for dispersing high concentrations of molten Mg or Mg alloy into globules; then when the mixture is cooled, the metal globules freeze first and upon further cooling the salt freezes, thus forming the metal beads into clusters of beads adhered together by a friable salt matrix. The more pure the eutectic salt mixture, the higher one can go with the concentration of molten metal without encountering a substantial amount of coalescence of dispersed metal during cooling. Coalescence of dispersed metal droplets can occur after agitation is stopped, but before the metal globules have frozen, if agents conducive to coalesence are present. Among the agents which are conducive to coalescence are e.g., $CaF_2$ and $MgCl_2$. To a large extent, the effect of coalescing agents is offset by the presence of dispersing agents such as boron and/or lampblack. To attain a dispersion of metal beads in a friable salt matrix of very high concentrations, even though the frozen beads be in "clusters", it is preferred that there be very little, or none, of the agents which cause coalescence; in this case, the need for dispersing agents (to avoid coalescence) is obviated, though they may be used advantageously as a means for controlling or adjusting the particle size distribution of the particle size average. In the context of the presently claimed embodiments, "coalescence" refers to the running together of molten globules to form large globules which are not of the "dispersed" sizes of interest here.

FIGS. 5–7 are presented as artistic illustrations or conceptualizations to aid in an explanation of the perceived differences between "well-dispersed" particles and "clusters" of particles. The particle sizes in the figures are highly magnified, but not to scale, and for ease of illustration the salt-coated particles are shown in cross-section as cutaway partial views.

In FIG. 5 there are portions of two beads, 1A and 1B, each having a tightly-bound salt coating, 2A and 2B respectively, and the friable salt matrix, 3, separating the coated beads. This represents "well-dispersed" particles.

In FIG. 6 it is shown that two "clustered" beads, 1A and 1B, are in such close proximity that there is a point at which they appear to more or less share a portion of their tightly-bound salt coatings, (2A and 2B). As shown, there appears to be a tendency for the beads to press tightly together and a small bit of their surfaces at the point of "cluster" may become slightly flattened (2C). Virtually any number of such beads can be involved in a clustered mass of beads. When the clusters are broken into discrete beads by milling, each bead substantially retains its shape and its tightly-bound salt coating, and the salt matrix (3) in the interstices of the cluster may be pulverized and is easily separated, such as by screening, from the discrete salt-coated beads.

In FIG. 7 it is shown that there may be some beads which are so tightly clustered with other beads that there may be actual metal-to-metal contact (2D) through a thin shared salt-coating (2C). As shown there are two beads, 1A and 1B which have a tightly-bound salt coating, 2A and 2B respectively, and a friable salt matrix (3) filling the interstitial spaces among the beads. A thin salt coating (2C) is shared by beads 1A and 1B and there is some penetration of shared layer (2C) by metal-to-metal contact (2D). As in FIG. 6, this shared layer or point of juncture is illustrated as being slightly flattened due to the "crowded" conditions encountered when the amount of Mg globules in the molten mixture exceeds the amount of salt. At this high concentration of molten Mg globules in the molten mixture there are likely to be found numerous instances where the globules are somewhat distorted (slightly flattened) in places by pressure from neighboring globules and these distortions, as slight as they may be, are likely to be retained in the frozen beads. It will be understood that the globules, generally all falling within the range of about 8 mesh to about 100 mesh, are not all of the same size and there are small particles distributed among larger particles.

THE PROCESS IN GENERAL

A molten mixture of salt (matrix) and Mg or Mg alloy is stirred to cause the Mg or Mg alloy to disperse as small droplets in the melt. In certain embodiments boron is added as a dispersant. Following this the molten mixture is allowed to cool (freeze) to a temperature which permits easy handling and to obtain the mixture as a friable matrix containing solid rotund Mg or Mg alloy particles dispersed therein. The cooled mixture may then be broken up (if needed) into pieces suitable for feeding to a hammer mill where the friable matrix may be broken away from the metal beads. The metal beads still retain a thin protective coating of the matrix adhered thereto. The matrix-coated (also called salt-coated) metal beads may be separated from the pulverized matrix material by screening, by air-classifying, by tabling on a slanted table, or by any convenient means. Alternately, the salt matrix containing the entrapped Mg granules may be supplied to users who may then process or use it in the manner of their own choosing.

The amount of Mg or Mg alloy dispersed in the matrix should in some cases be limited to a concentration, by weight, of about 42% or less if a non-clustered product is desired; above this amount it is difficult to avoid having clusters of metal beads adhered to, or coalesced with, each other when cooled. Preferably, the amount of Mg or Mg alloy in the matrix is held to a maximum of about 38–40% to be substantially assured of no "off-spec" metal, i.e., metal which is not present as small, rotund, discrete beads. There is no particular minimum amount of Mg or Mg alloy from an operability standpoint, but from a practical standpoint, it appears best if the amount of Mg or Mg alloy dispersed in the matrix is at least an amount such as is found in various sludges or slags from Mg-production or from casting operations. However, such low concentrations are beneficially increased by adding Mg or Mg alloy to the melts to bring the metal content up to about 42%, preferably about 38–40%.

In order to achieve a high concentration of non-coalesced Mg of Mg alloy beads in the frozen salt matrix, where said high concentration is greater than about 42% of metal beads by wt. and as high as about 70% or more, then it is preferred that the salt mixture have little or no ingredients which act as coalescing agents (such as $CaF_2$ or $MgCl_2$). At such high concentration one does encounter clustering of the metal beads, but these clusters can be milled, such as in a hammer mill or other gentle grinding, to break apart the clusters and free each Mg bead from being adhered to other beads, but without flattening, splitting or rupturing a substantial amount of the beads. The clustered beads are conveniently retrieved as separate, substantial rotund particles, each having a substantial amount of its surface protected by a thin protective salt coating. Any portion of the Mg bead surface, which may be temporarily exposed by the separation of beads which are tangentially joined, (metal-to-metal) is substantially recoated with fine salt powder during the milling operation; only a small percent, if any, is likely to be of the metal-to-metal type. In the clusters of beads, the majority, sometimes all, of the beads are adhered to others by a thin salt layer between them, rather than by being tangentially joined in metal-to-metal fashion; this salt layer can be broken by milling, without destroying the bead, and the beads retain their salt coatings.

Depending on the extent of the milling, the final salt content of the Mg granules, after screening out the pulverized salt matrix, is usually about 3% to about 15% depending on the intensity and/or duration of the milling operation. Further "polishing" to reduce the salt content to about 1–2% is possible by extended milling times.

Any temperature at which the metal and the matrix is molten may be used and for many of the mixtures (i.e. cell bath, cell sludge, casting slag, etc.) which may be used in the present invention, a temperature in the range of about 670° C. to about 820° C. is usually employed in the dispersing step. We have found, in the case of Mg or Mg-Al alloy in production sludges or casting slags, that the preferred temperature of the melt, during the dispersing step, is about 730° to about 790° C. At about 730° C. or less the dispersing step generally requires more time and there appears to be a greater tendency for the small metal beads to re-coalesce into larger beads or unite into clusters. At temperatures of about 790° C. or greater, there is a greater tendency for the molten Mg to burn at the surface of the melt and greater care must be exercised to blanket the melt with a substantially inert atmosphere during the melt operation and sometimes during the pouring operation when the melt is removed from the melting vessel. Such "burning" oxidizes some of the Mg to MgO.

When using salt mixtures which are predominantly NaCl and KCl, optionally containing a minor amount of $CaCl_2$ or $BaCl_2$, but having little or no $MgCl_2$ or $CaF_2$ (or other coalescence agent), it is preferred that the molten mixture of salt and Mg be stirred in the temperature range of about 600° C. to about 700° C., which is a temperature only a little above the freezing point of Mg (viz. about 650° C.). These mixtures, when removed from the mixing vessel and chilled as blocks, sheets, or other frozen masses, undergo very little, if any, oxidation of the Mg because it freezes quickly as the temperature drops to about 650° C. and then as the casting chills further, the salt freezes into a friable mass, thereby entrapping the Mg beads.

The amount of boron-containing dispersing agent (when employed) should be a minimum (as boron) of about 400 ppm (based on Mg or Mg alloy) and is preferably about 800 ppm or higher. Ordinarily, the preferred amount of boron-containing dispersing agent is in the range of about 800–2000 ppm; greater amounts may be used but there is no additional benefit to be derived from such greater amounts.

The boron-containing dispersing agent may be any boron-containing mixture or compound which will dissolve in, or release boron values into, the matrix material, e.g., boric acid, alkali metal borates, borax, boron halides, boron oxides and metal perborates and the like. Less preferred (though operable), because of expense or hazard, are the organo-boron compounds, boron hydrides or gaseous boron.

The use of very fine particle carbon, such as lampblack, may be beneficially added with the boron as a dispersing aid. Lampblack is known to be somewhat effective as a dispersing aid and, in fact, such fine particle carbon is sometimes found as a carbon residue of organic material which has found its way into sludge, flux, or slag material. The presence of such carbon residue in cell bath sludge, for instance, is known or believed to make coalesence of the Mg difficult, thereby creating a need for additional coalescence agents (such as $CaF_2$) when primary Mg is produced in fused salt electrolysis. The amount of lampblack, if it is added, may be up to about the amount of boron which is added, but preferably is only about half or less of the amount of boron added. If there is already an appreciable amount of very fine carbon in the slag or sludge, or in the Mg or Mg alloy added thereto, there may be little or no benefit to adding more carbon.

The minimum amount of time involved in stirring the melt to disperse the added boron and the metal is somewhat dependent on the stirring speed, the temperature of the melt, the concentration of the Mg or Mg alloy, the viscosity of the melt, and the amount of boron added (if any). Lower temperatures, higher Mg or Mg alloy concentrations, higher viscosities, and lower concentrations of boron generally require greater stirring times and/or stirring speeds. Generally, the amount of time involved ranges from about 30 minutes under the slowest conditions to about 0.5 minutes under the fastest conditions, assuming of course that the stirrer is adequately sized for the volume of melt involved and is operated at an adequate speed. A four-blade stirrer, operated at a tip speed of about 1500 to about 4000 feet/minute has been found to be particularly effective in obtaining good mixing and good dispersions. Stirrers having from two to eight blades are ordinarily used. An air-motor provides a convenient and relatively safe means for powering the stirrer, though other power sources may be used. Eutectic mixtures of NaCl/KCl have relatively low viscosities, when molten, and are easily stirred.

The amount of boron (when used) found in the salt-coated metal beads after separation of the beads from the pulverized matrix is usually not more than about 100–200 ppm (on 100% Mg basis). This small amount of boron is not a detrimental amount when the beads are employed as an inoculant material for molten ferrous metals.

The amount of matrix material (salt) adhered as a coating to the metal beads after pulverizing of the matrix is normally in the range of about 2% to about 20% of the total weight, and is preferably in the range of about 8% to about 12% if the material is to be used as an inoculant for molten ferrous metals.

During the hammer-milling, screening, size-classification, or other handling of the salt-coated metal beads, it is preferred that the atmosphere in contact with the beads be dry or relatively dry. Many salts are hygroscopic and tend to pick up moisture from the air; this makes screening and classification difficult as the moisture tends to cause clinging of the particles to each other and to other surfaces. A relative humidity of less than about 35%, preferably less than about 20%, should be used so as to avoid complications.

The pulverized matrix is beneficially recycled by adding more Mg or Mg alloy, and make-up salts if desired, and re-melting it for further formation and recovery of rotund metal beads. Such recycled salt will normally carry with it some of the boron values (if used) from the previous operation, thereby requiring very little, if any, additional boron to obtain the desired dispersion of melt. Also, any "off-spec" material from a given granule-forming operation may be recycled to become a part of a subsequent operation.

EXPERIMENTAL

A series of examples were made under comparative conditions in a small demonstration plant using 20-lb. (~9.07 kg) melts containing about 40% Mg metal in a pot about 7 inches (18 cm.) in diameter and about 10 inches (25.4 cm.) deep. The melts were done at about 1400° F.±25° (760° C.±14°), stirring was done at about 4000–4500 rpm using a three-bladed impeller of one-inch (2.54 cm) blades which gave a tip speed of about 2094–2356 ft./min. (638–820 meters/min.), using a stirring time of about 60 seconds.

The melts were chilled to well below their freezing points by being poured onto a revolving chilled roller on a flaking machine where the frozen friable material formed as a thin sheet which broke up into flakes as it was scraped from the chilled roll by a scraper blade. The water-cooled roll was 12 inches (30.48 cm) diameter and 36 inches (91.44 cm) long.

In each batch of material representative samples of the flakes, when it was apparent that some dispersion had taken place, were photomicrographed at 4-power magnification and particle size distribution was measured using a ruler. From a visual study of the melts, the cooling, and/or the photomicrographs the results were classified in one of the following categories:

1. No dispersion—this means that virtually all the Mg metal was present as one or more large pieces and there was no visible evidence that any of the Mg was present as small, discrete globules or beads;

2. Totally coalesced—this means that some dispersion was apparent during stirring, but when stirring was stopped and before freezing occurred on the chill-roll, it could be seen that the Mg globules had coalesced to form large particles or united into clusters of particles and rapidly lost their dispersity.

3. Partially coalesced—this means that when stirring was stopped, and before freezing occurred, a significant amount of the disperse Mg metal coalesced into large particles or united into clusters, yet an appreciable amount remained dispersed as small, rotund discrete beads.

4. Well dispersed—this means that after stirring there was no apparent coalescence of the small, rotund discrete Mg metal beads and virtually all the beads could pass through a 10-mesh screen after being freed from entrapment in the friable matrix. This category is given in the examples as a mesh size, representing the number average size of the salt-coated Mg beads.

As used in these examples, the expression "small, discrete beads" refers to beads which are small enough to pass through a 10-mesh screen and which are not attached to other beads. The boron values are supplied as boric acid. The tests were made in a dry ambient atmosphere of not more than 35% relative humidity so as to avoid moisture problems with those salts which are hygroscopic. Salt mixtures of the following compositions were tested:

| Sample | Approx. % Compound in Salt Mixture | | | | | |
|---|---|---|---|---|---|---|
| No. | $MgCl_2$ | NaCl | KCl | $CaCl_2$ | $CaF_2$ | $BaCl_2$ |
| A | 6.0 | 59.0 | 20.1 | 13.8 | 1.1 | — |
| B | 12.0 | 55.3 | 18.8 | 12.9 | 1.1 | — |
| C | 18.0 | 51.5 | 17.5 | 12.0 | 1.0 | — |
| D | 20.0 | 50.5 | 17.0 | 11.5 | 1.0 | — |
| E | 25.0 | 47.1 | 16.0 | 11.0 | 0.9 | — |
| F | 30.0 | 44.1 | 14.9 | 10.2 | 0.8 | — |
| G | 36.0 | 40.2 | 13.6 | 9.5 | 0.7 | — |
| H | 18.2 | 52.0 | 17.7 | 12.1 | 0 | — |
| I | 17.8 | 51 | 17.3 | 11.9 | 2.0 | — |
| J | 17.2 | 49.5 | 16.7 | 11.6 | 5.0 | — |
| K | 17.9 | 51.3 | 17.4 | 11.9 | 1.0 | 0.5 |
| L | 17.0 | 49.0 | 16.5 | 11.5 | 0.9 | 5.0 |
| M | 16.2 | 46.7 | 15.8 | 10.6 | 0.7 | 10.0 |
| N | — | 62.8 | 21.3 | 14.6 | 1.2 | — |
| O | 13.9 | 62.5 | 13.5 | 9.3 | 0.8 | — |
| P | 10 | 73.0 | 9.7 | 6.7 | 0.6 | — |

The above salt samples were melted, the Mg metal content brought to about 40% and, in some cases, various amounts of boron or other ingredients were added with stirring. The visual observation of the amount of coalescence and dispersion was noted for each melt. The cooled flakes from the chilled roll were broken up in a hammer mill in those instances where the Mg metal was found to be "well dispersed". Following the hammer milling the pulverant was screened to separate pulverized matrix from the salt-coated rotund Mg beads.

The following table demonstrates the amount of boron in the melts and the amount of coalescence or dispersion obtained. In the table "DO" means "ditto".

| Sample No. | Boron ppm | Carbon ppm | Coalesence or Dispersion | No. Av. Particle Size (mesh) | Variable Studied |
|---|---|---|---|---|---|
| A | 0 | — | well dispersed | 50 | boron |
| A | 500 | — | " | 50 | " |
| A | 1000 | — | " | 48 | " |
| A | 1500 | — | " | 45 | " |
| A | 2000 | — | " | 43 | " |
| C | 0 | — | partially coalesced | — | boron |
| C | 400 | — | well dispersed | 20 | " |
| C | 1000 | — | " | 20 | " |
| C | 2000 | — | " | 20 | " |
| G | 0 | — | no dispersion | — | boron |
| G | 400 | — | well dispersed | 15 | " |
| G | 1000 | — | " | 15 | " |
| G | 2000 | — | " | 15 | " |
| H | — | — | well dispersed | 40 | $CaF_2$ |
| I | — | — | totally coalesced | — | " |
| J | — | — | no dispersion | — | " |
| K | — | — | well dispersed | 35 | $BaCl_2$ |
| L | — | — | " | 45 | " |
| M | — | — | " | 48 | " |
| B | 1950 | — | well dispersed | 35 | $MgCl_2$ |
| D | 1950 | — | " | 22 | " |
| G | 1950 | — | " | 15 | " |
| N | — | — | well dispersed | 55 | $MgCl_2$ |
| A | — | — | " | 50 | " |
| B | — | — | " | 35 | " |
| C | — | — | partially coalesced | — | " |
| E | — | — | totally coalesced | — | " |
| F | — | — | no dispersion | — | $MgCl_2$ |
| G | — | — | no dispersion | — | " |
| C | — | — | partially coalesced | — | NaCl |
| O | — | — | well dispersed | 25 | " |
| P | — | — | well dispersed | 35 | " |
| C | — | 0 | partially coalesced | — | lamp-black |
| C | — | 400 | well dispersed | 35 | " |
| C | — | 1700 | " | 35 | " |
| C | — | 3200 | " | 35 | " |

Hammer milling of the flakes in a single stage, with the pulverant falling through a ⅜-inch grate generally results in salt-coated beads having Mg content of about 65–70% by weight. Passing the pulverant through a second hammer mill stage having a ⅜-inch or 3/16-inch grate results in salt-coated Mg beads having about 75–80% Mg by weight. Subsequent hammer mill stages having a 10-mesh grate generally results in salt-coated beads having about 80–95% Mg by weight. The repeated hammer milling does not appear to substantially affect the size or rotundity of the Mg bead, but merely reduces the thickness of the salt-coating on the beads. If desired, additional "polishing" of the Mg beads to further reduce the thickness of the salt-coating may be performed.

A collection of batches having bead sizes of less than 10 mesh is screened and is found to have a nominal particle size distribution as follows:

| Particle Size Range (U.S. Standard Sieve) | Percent of Total |
|---|---|
| 10 × 20 | 27.6 |
| 20 × 30 | 20.7 |
| 30 × 40 | 27.4 |
| 40 × 50 | 24.3 |

As can be seen from the foregoing experiments, the tendency of the molten Mg or Mg alloy to become dispersed in the molten salt is somewhat dependent on salt composition. Increasing the $MgCl_2$ to above about 22% or $CaF_2$ to about 2% or more generally causes a greater tendency to coalesce. Increasing the $BaCl_2$ content has little effect, but the tendency is toward better dispersion. Increasing the NaCl content generally increases the tendency to disperse, but this may be partly due to the accompanying reduction in $MgCl_2$. It appears that $CaCl_2$ and/or $BaCl_2$ in the salt mixture tends to lower the viscosity of the melt, thus is beneficial in obtaining dispersion of high concentrations of Mg in the melt.

The above-described samples A through P, in those instances in which no boron or carbon dispersing aids were added, are plotted in FIGS. 1–4 and FIG. 8. In all the figures the given values (or a value computed from the given values) are plotted abainst "No Disp." (no dispersion), "Total Coal." (total coalescence), "Part. Coal." (partially coalesced), and number average particle size (mesh) or "well dispersed" samples. The samples which are "well dispersed" are preferred, and those which are "partially coalesced" are marginally operable and acceptable.

FIG. 1 plots % $MgCl_2$, % NaCl, and % NaCl/KCl versus the results of the stirring and cooling. The data points for Samples I and J are not included because of the high $CaF_2$ content (2% and 5% respectively).

Figure 2:
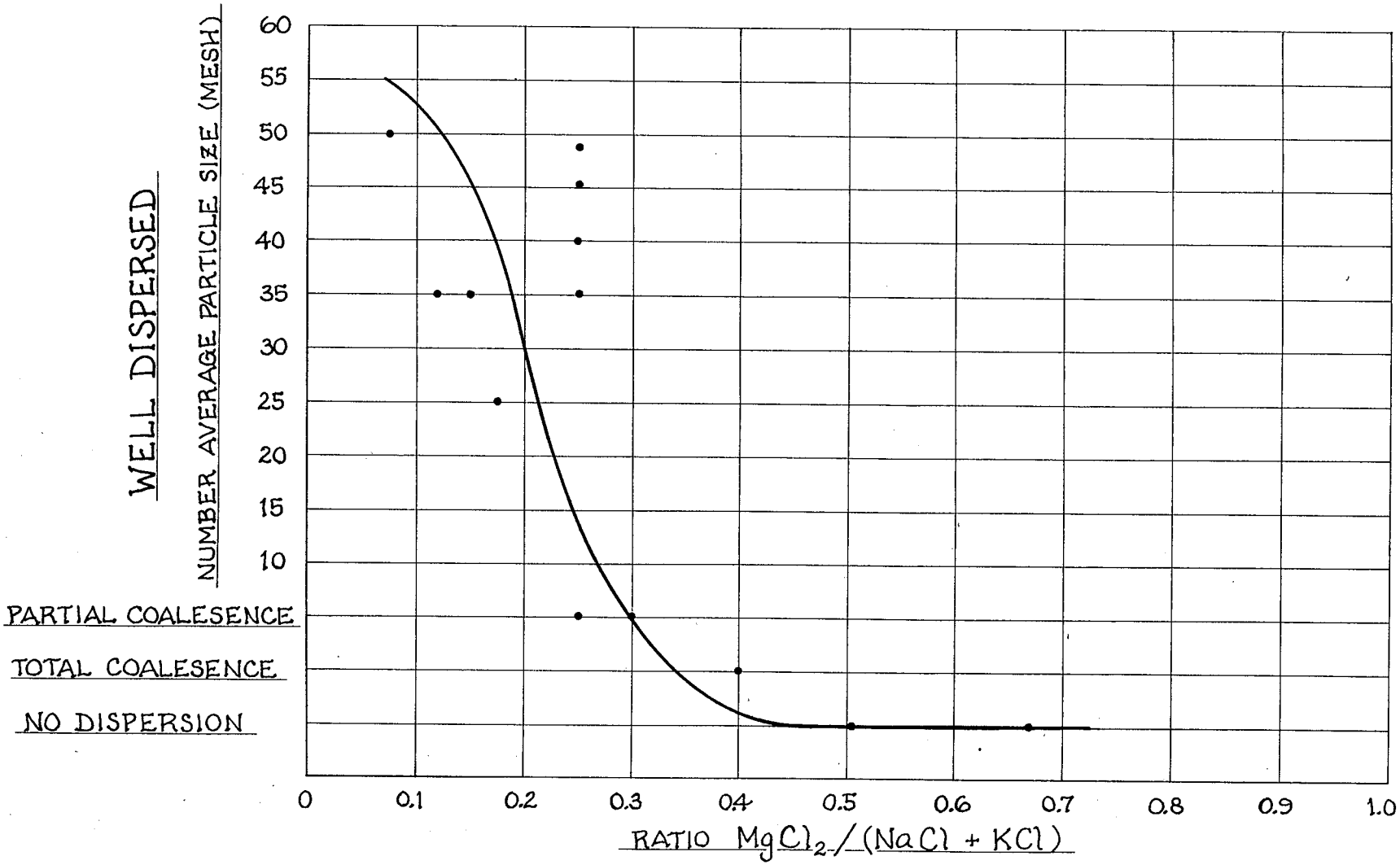

FIG. 2 plots the ratio of $MgCl_2$/(NaCl+KCl) from FIG. 1 versus dispersity.

Figure 3:
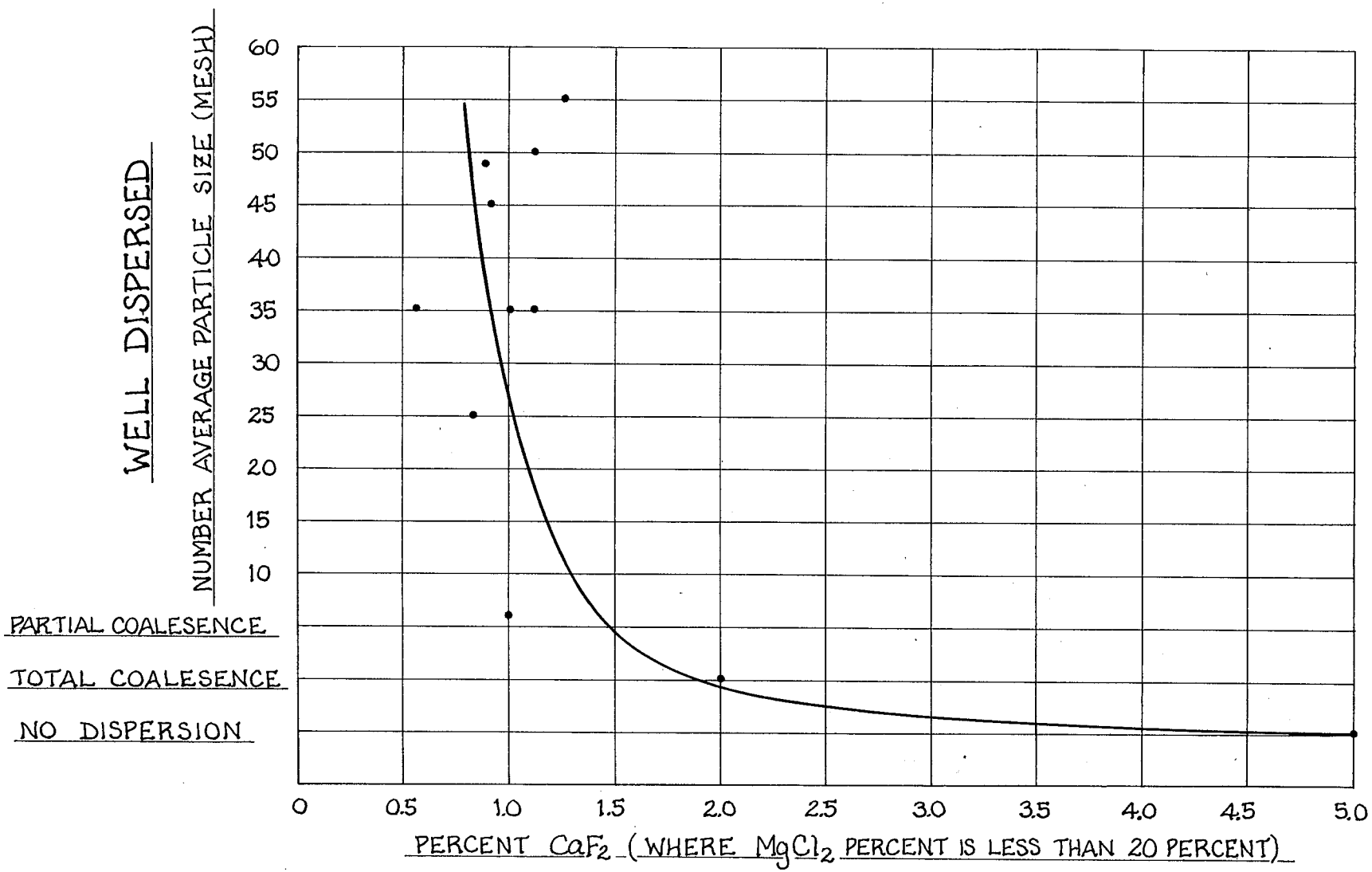

FIG. 3 plots % $CaF_2$, excluding samples E, F, and G which are high in $MgCl_2$ content.

Figure 4:
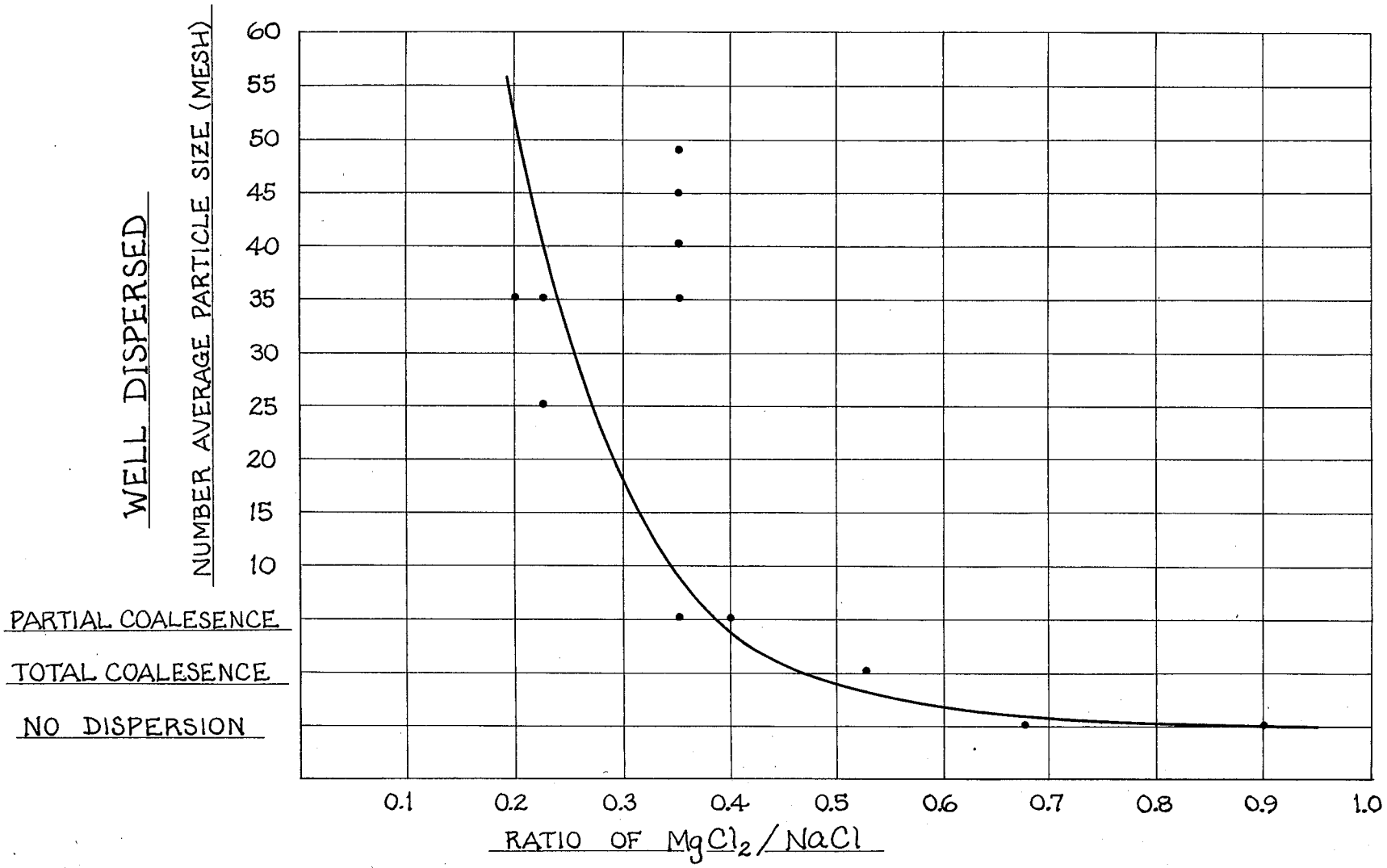

FIG. 4 plots the ratio of $MgCl_2$/NaCl from FIG. 1 versus dispersity.

Figure 8:
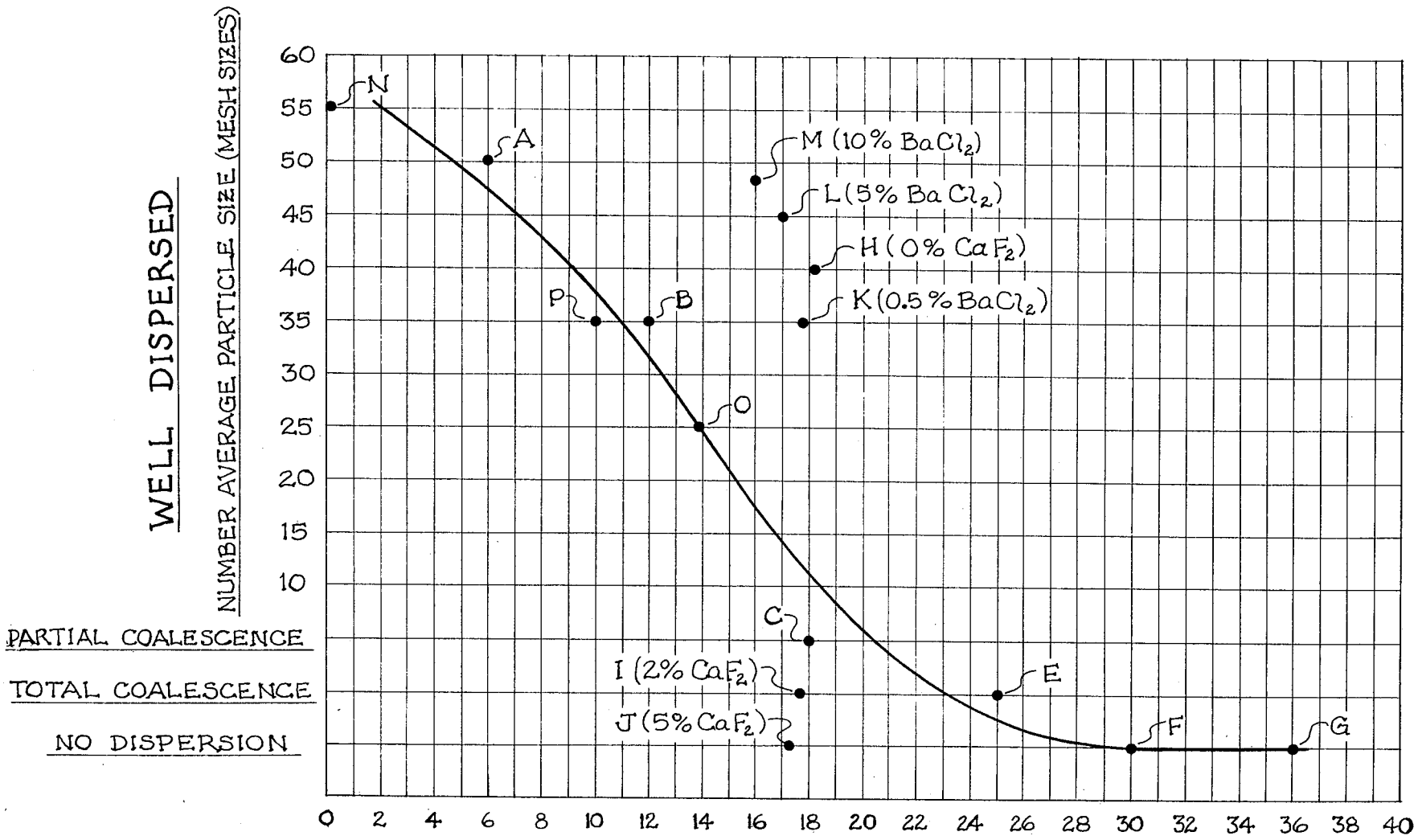

FIG. 8 plots the "no-boron added" runs for Samples A, B, C, E, F, G, N, O, and P along which data points a curve is drawn. Runs I and J are shown below the curve to show the effect of increased amounts of $CaF_2$ at the given $MgCl_2$ percentage. Run H, with no $CaF_2$ but at about the same $MgCl_2$ percentage, is well above the curve to show greater dispersion. Runs K, L, and M, which contain $BaCl_2$ are well above the line, showing greater dispersity at about the same $MgCl_2$ percentage. Higher loadings of Mg metal in the molten mixture, up to about 70% or more, are achievable at low $MgCl_2$ percentages (especially at or near zero), especially if $CaCl_2$ and/or $BaCl_2$ is present and there is little or no $CaF_2$ present in the molten mixture.

EXAMPLE

A molten mixture of salt (40% by wt.) and Mg (60% by wt.) is stirred in a vessel at a temperature in the range of about 660° C. to about 700° C. to cause the Mg to disperse into small globules. The molten mixture is transferred into ingot molds for freezing. The ingots are broken up by the use of a hammer mill to pulverize the frozen salt matrix and free the Mg beads entrapped therein, but still retaining a thin coating of salt on each bead. The milling also breaks up clusters of beads. Substantially all the Mg beads are found, upon screening, to be in the 8–100 mesh size range. The salt mixture employed is predominantly a eutectic mixture of NaCl (~55%) and KCl (~25%), but which contains minor amounts of $CaCl_2$ (~10%), and $MgCl_2$ (~10%) and it has a freezing point of at least about 10° C. below the freezing point of the Mg. Thus, as the molten mixture cools the Mg globules freeze before the salt matrix freezes. Though many of the beads are in the form of clusters, these clusters are composed substantially of beads which have a very thin layer of salt adhering them together, and there is little evidence that the beads are united tangentially with metal-to-metal adhesion.

In any event the present process provides a means for employing salt mixtures from various sources whereby, with the addition of boron values, a well dispersed Mg metal is substantially assured without having to adjust the process to accomodate the various tendencies toward coalescence which may be found with the various sources. Thus salt mixtures from various sources, e.g., Mg cell feed, Mg cell sludge, Mg or Mg alloy slags, etc., may be used in the present process with the Mg or Mg alloy content being adjusted upwardly, if desired, and by employing a boron dispersant the Mg or Mg alloy may be consistently dispersed in the melt to achieve substantially regular sizes of rotund beads without having to adjust the process to accomodate the variances in the salt mixtures. If no dispersing aid is added, good dispersity is attained by maintaining or adjusting the amount of alkali metal chloride to assure that the $MgCl_2$ content is less than about 22% and the metal fluoride content is less than about 2%. It is also preferred that the weight ratio of $MgCl_2$/NaCl in the salt mixture be less than about 0.4 and that the ratio of $MgCl_2$/total alkali metal chloride be less than about 0.35. It is preferred that the total alkali metal chloride content of the salt mixture be at least 46%, most preferably at least about 50%. The alkali metal chloride may be NaCl, KCl, or LiCl, and is preferably a mixture containing predominantly NaCl. In those instances where it is desired to increase the content of alkali metal chloride, it is generally preferred, because of cost and availability, to employ additional NaCl, though additional KCl and/or LiCl is operable.

Though the present disclosure is made with particular emphasis on the use of salt-coated Mg beads as inoculants for molten ferrous metals, it will be readily understood by practitioners of the relevant arts that the beads have other uses such as for additives to other molten metals.

The present invention is readily useful and adaptable to situations where the Mg granules, still entrapped within a contiguous, friable salt matrix, may be shipped as such to various users. The various users then are thus provided with the opportunity of using such product in whatever manner they prefer, including the opportunity of selecting their own milling operation.

Embodiments other than those illustrated in this disclosure will become apparent to practitioners of the relevant arts, upon learning of this invention, and the present invention is limited only by the following claims and not by the particular embodiments illustrated here.

We claim:

1. A process for producing salt-coated magnesium or magnesium alloy beads, said process comprising stirring a mixture of molten magnesium or magnesium alloy and molten salt to cause dispersion of the magnesium or magnesium alloy as small beads in the molten salt and freezing the mixture to entrap the magnesium or magnesium alloy beads in a salt matrix, wherein said magnesium or magnesium alloy comprises up to about 70% of the total weight of the mixture, wherein said salt comprises NaCl mixed with a sufficient quantity of KCl, LiCl, $CaCl_2$ and/or $BaCl_2$ to give a mixture having a melting point below 650° C., but containing little or no $CaF_2$ or $MgCl_2$, said salt mixture having a freezing point lower than the freezing point of the magnesium or magnesium alloy.

2. The process of claim 1 wherein the salt mixture contains not more than a trace amount of $CaF_2$ and/or $MgCl_2$ and where the magnesium or magnesium alloy comprises about 42% to about 70% of the total weight.

3. The process of claim 1 wherein the salt mixture comprises a eutectic mixture of NaCl and KCl optionally containing a small percentage of $BaCl_2$, $CaCl_2$ and/or LiCl, said small percentage of $BaCl_2$, $CaCl_2$ and/or LiCl being an amount which does not elevate the eutectic freezing point to a temperatue closer than about 10° C. to the freezing temperature of the magnesium or magnesium alloy, said salt mixture being substantially devoid of $CaF_2$ and/or $MgCl_2$, said magnesium or magnesium alloy comprising about 60% to about 70% by weight of the total.

4. The process of claim 1 wherein the salt is substantially devoid of agents which tend to cause coalescence of the dispersed molten magnesium or magnesium alloy globules to large globules in the molten salt after stirring is ceased, but before the molten globules are frozen.

5. The process of claim 1 wherein the molten mixture contains a minor, but effective, amount of a dispersing aid to enhance the dispersing of the metal globules.

6. The process of claim 1 wherein the molten mixture contains a minor, but effective amount of boron values and/or finely divided carbon as an aid to dispersing the metal globules.

7. The process of claim 1 wherein the beads are freed from entrapment in the frozen salt matrix by milling the frozen mixture in a manner which does not flatten, crush, or break a substantial amount of the beads, but which pulverizes the salt matrix, yet which leaves a thin, tightly adhered salt coating on the surface of each bead, the pulverized salt matrix being separated as a powdery material from the so-produced salt-coated beads.

8. The process of claim 1 wherein substantially all the beads entrapped in the frozen salt matrix are in the particle size range of about 8 mesh to about 100 mesh, U.S. Standard Sieve Size.

9. The process of claim 1 wherein said salt comprises a eutectic mixture of NaCl and KCl, containing 0–10% of $BaCl_2$, 0–10% LiCl and/or 0–15% $CaCl_2$, but which is substantially devoid of $CaF_2$ and/or $MgCl_2$, and wherein the magnesium or magnesium alloy comprises about 60% to about 70% of the total melt.

10. A process which comprises forming a molten mixture of Mg or Mg alloy and salt, said Mg or Mg alloy comprising up to about 70% by weight of the mixture, said salt being a mixture comprising a majority amount of alkali metal halides and not more than a minor amount of alkaline earth metal halides, said salt having a freezing point substantially below that of the Mg or Mg alloy, stirring the molten mixture to effect dispersion of the molten Mg or Mg alloy as small, disperse globules in the molten salt, transferring the molten mixture, at a temperature slightly above the freezing temperature of the Mg or Mg alloy, to a receiver which permits substantially rapid cooling of the mixture to cause the Mg or Mg alloy globules to freeze into beads, and further cooling to freeze the molten salt, thereby entrapping the so-formed Mg or Mg alloy beads in a friable salt matrix.

11. The process of claim 10 wherein the alkali metal halides comprise principally NaCl along with a lesser amount of KCl and/or LiCl.

12. The process of claim 10 wherein the alkaline earth metal halides comprises at least one selected from the group comprising $BaCl_2$, $CaCl_2$, and $MgCl_2$, and where $MgCl_2$ is not greater than about 10%.

13. The process of claim 10 wherein the alkali metal halides comprise a mixture of NaCl and KCl.

14. The process of claim 10 wherein the alkali metal halides comprise a mixture of NaCl and KCl and the alkaline earth metal halides comprise $CaCl_2$ and/or $BaCl_2$.

15. The process of claim 10 wherein the alkali metal halides comprise a mixture of NaCl and KCL and the alkaline earth metal halide comprises $BaCl_2$.

16. The process of claim 10 wherein the molten mixture comprises Mg and a salt mixture, said Mg comprising an amount in the range of about 45% to about 70% by weight of the total, said Mg having a freezing point of about 650° C., said salt mixture comprising the remaining percentage of the total weight and being comprised principally of NaCl and KCl along with 0–10% $BaCl_2$, 0–15% $CaCl_2$, 0–10% LiCl, less than 1% $CaF_2$, and/or less than 10% $MgCl_2$, said salt mixture having a freezing point below 650° C., said molten mixture being transferred, at a temperature of about 660°–700° C., from the dispersion-forming step to the freezing step.

17. The process of claim 10 wherein the Mg or Mg alloy comprises about 60% to about 70% of the total weight of the mixture, said salt mixture comprising principally NaCl and KCl, optionally also containing minor amounts of $BaCl_2$ and/or $CaCl_2$, but containing little or no $CaF_2$ and/or $MgCl_2$, said salt mixture having a freezing point below the freezing point of the Mg or Mg alloy, said salt mixture also containing a minor, but effective, amount of a dispersing aid for the dispersion of the molten Mg or Mg alloy as globules in the molten salt mixture.

18. The process of claim 10 wherein said molten mixture also contains a minor, but effective, amount of a dispersing aid.

19. The process of claim 10 wherein said molten mixture also contains as a dispersing aid, a minor amount of finely divided carbon and/or boron values.

20. The process of claim 10 wherein the salt mixture comprises a eutectic mixture of NaCl and KCl having a freezing point below about 650° C.

* * * * *

UNITED STATES PATENT AND TRADEMARK OFFICE

CERTIFICATE OF CORRECTION

PATENT NO. : 4,559,084

DATED : December 17, 1985

INVENTOR(S) : Edward J. Skach, Jr. and George B. Cobel

It is certified that error appears in the above-identified patent and that said Letters Patent is hereby corrected as shown below:

Column 3, line 55, correct "thant" to --that--.

Column 4, line 11, correct "electroytic" to --electrolytic--.

Column 7, line 63, correct "coalesence" to --coalescence--.

Column 10, line 59, correct "coalesence" to --coalescence--.

Column 13, line 15, in the table heading correct "Coalesence" to --Coalescence--.

Column 14, line 31, correct "abainst" to --against--.

Column 16, line 30, correct "temperatue" to --temperature--.

Signed and Sealed this

*Twenty-second* Day of *July 1986*

[SEAL]

*Attest:*

DONALD J. QUIGG

*Attesting Officer*

*Commissioner of Patents and Trademarks*